US005088849A

United States Patent [19]

Johnson et al.

[11] Patent Number: 5,088,849

[45] Date of Patent: Feb. 18, 1992

[54] APPLICATOR FOR APPLYING LIQUIDS TO THE HUMAN BODY

[75] Inventors: Jeff H. Johnson, 1545-J Terrell Mill Pl., Marietta, Ga. 30067; Tom D. Bowers, Atlanta, Ga.

[73] Assignee: Jeff H. Johnson, Marietta, Ga.

[21] Appl. No.: 561,345

[22] Filed: Aug. 1, 1990

[51] Int. Cl.[5] ..... A45D 34/00; A47L 13/16

[52] U.S. Cl. ..... 401/44; 401/6; 401/45; 401/46; 401/47; 401/146; 401/150; 401/140; 401/196; 401/207; 604/310

[58] Field of Search ..... 401/6, 44, 45, 46, 47, 401/143, 146, 149, 150, 140, 196, 207; 604/310

[56] References Cited

U.S. PATENT DOCUMENTS

| | | | |
|---|---|---|---|
| D. 285,172 | 8/1986 | Seuderi . | |
| 1,007,042 | 10/1911 | Mosby . | |
| 1,154,349 | 9/1915 | Tanaka | 401/47 X |
| 1,598,742 | 9/1926 | Parker | 401/289 X |
| 1,601,596 | 9/1926 | Paskach . | |
| 1,610,595 | 12/1926 | Rudolph . | |
| 1,763,905 | 6/1930 | Rusell . | |
| 2,572,538 | 10/1951 | Teters | 401/46 X |
| 2,661,870 | 12/1953 | Huenergardt | 401/47 X |
| 2,800,673 | 7/1957 | Lazisky | 401/6 X |
| 3,153,799 | 10/1964 | Williams . | |
| 3,184,780 | 5/1965 | Hageman | 401/146 |
| 4,171,171 | 10/1979 | Jones | 401/150 |
| 4,859,102 | 8/1989 | Chamieh | 401/46 X |
| 4,861,180 | 8/1989 | Adams | 401/150 X |
| 4,961,661 | 10/1990 | Sutton et al. | 401/6 |

FOREIGN PATENT DOCUMENTS

| | | | |
|---|---|---|---|
| 23173 | 8/1883 | Fed. Rep. of Germany | 401/47 |

*Primary Examiner*—Steven A. Bratlie
*Attorney, Agent, or Firm*—Rogers, Howell & Haferkamp

[57] ABSTRACT

An applicator for applying a plurality of liquids, such as for tanning, at the same time to the human body. The applicator includes a handle and an applicator head at the top of the handle. The head receives a pad for contact with the body where the liquids are to be applied. The handle has at least two chambers for separately containing the liquids. The liquids are fed from the chambers to the applicator pad for application to the body upon contact with the pad.

17 Claims, 2 Drawing Sheets

FIG. 4.
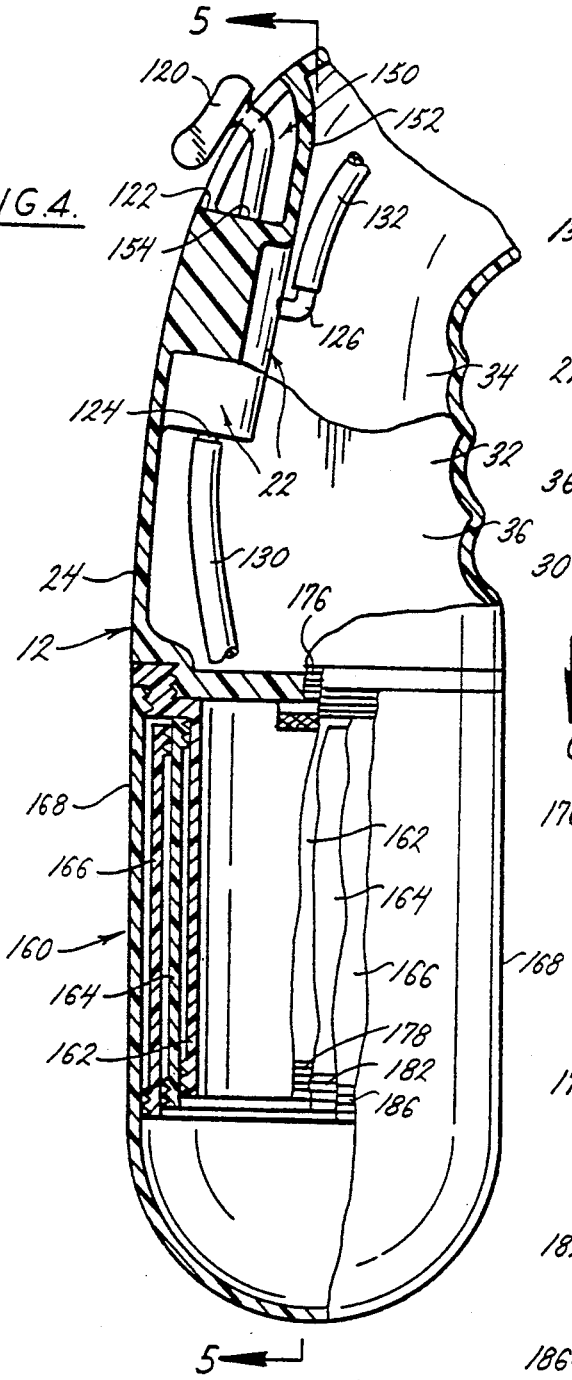
FIG. 5.
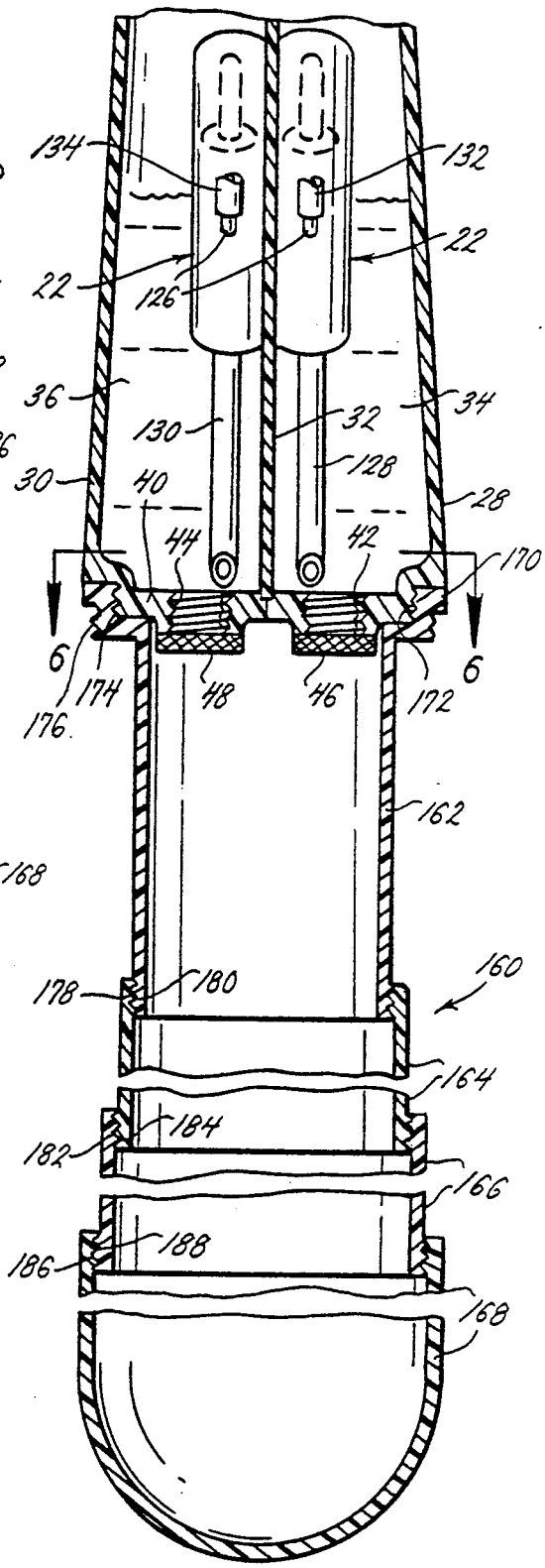
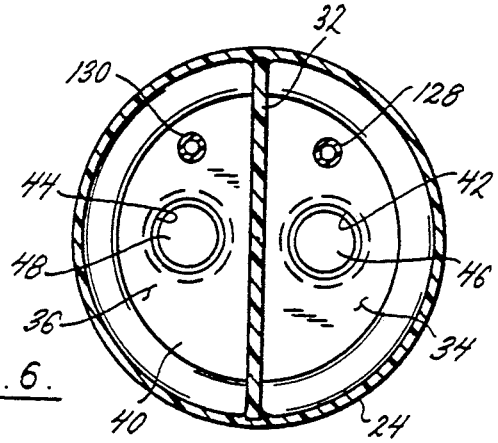
FIG. 6.

APPLICATOR FOR APPLYING LIQUIDS TO THE HUMAN BODY

BACKGROUND AND SUMMARY OF THE INVENTION

This invention relates to an applicator for applying liquids to the human body, and more specifically, to such an applicator for applying at least two different liquids at the same time. The applicator of the present invention finds particular use in applying suntan lotions or oils and water to the body at the same time, and makes it possible to reach areas that otherwise would be difficult to reach.

Applicators are known in the art for applying a liquid, such as suntan lotion or oil, to the body. Applicators are also known for dispensing more than one liquid. Examples of these are shown in U.S. Pat. Nos. 1,007,042, 1,610,595, 1,601,596, 1,763,905, 2,661,870, and 3,153,799. However, such applicators are not particularly suited for applying multiple liquids to the human body to prevent sunburn. The applicator of the present invention is uniquely designed for that purpose.

In accordance with the applicator of the present invention, there is provided a curved handle such that the applicator surface or pad that contacts the body for application of the fluids is at approximately 90° to the grip portions of the handle to make it easy for the user to apply the liquids to such hard to reach places as the back. The applicator pad itself is a soft sponge-like material with a slick permeable outer surface that feels smooth and soothing to the skin when applying the liquids to the body. The sponge provides even distribution of the liquids at the pad, and the permeable outer surface allows the passage of the liquids therethrough.

A distributor disk is located just beneath the sponge-like pad at the outer end of the head, the disk having first and second sets of openings. Means are provided for delivering one of the liquids to one set of openings and for delivering the other liquid to the other set of openings, the openings communicating with the pad. In this way, the liquids are separated until they enter the pad. The openings in the distributor disk are sized and spaced to provide a uniform distribution of the liquids throughout the pad.

Within the handle are multiple chambers for containing the liquids, and means are provided for feeding the liquids from the chambers to the distributor disk. Such means comprises pumps for pumping the liquids from the chambers to the distributor disk. In a preferred embodiment of the invention, the pumps are mounted to the back of the handle and have actuators accessible to the thumb of the user for operating the pumps while holding the applicator by the handle.

The handle further includes telescoping sections that operate between collapsed and extended positions to shorten or lengthen the handle as desired for easy access to portions of the body. A protective cap is removably secured to the outer end of the head over the pad to protect the pad and prevent leakage of the liquids therefrom when not in use.

Hence, it is a primary object of this invention to provide an applicator for applying multiple liquids, and which is particularly suited for applying such liquids to the human body to prevent sunburn, and such that in use the applicator is easy to use, reliable, and soothing to the skin.

These and other objects are apparent from the drawings and detailed description to follow.

DESCRIPTION OF THE DRAWINGS

FIG. 4 is a view in section taken generally along the line 4—4 of FIG. 1.

FIG. 5 is a view in section taken generally along the line 5—5 of FIG. 4.

FIG. 6 is a view in section taken generally along the line 6—6 of FIG. 5.

DETAILED DESCRIPTION OF A PREFERRED EMBODIMENT

Figure 1:
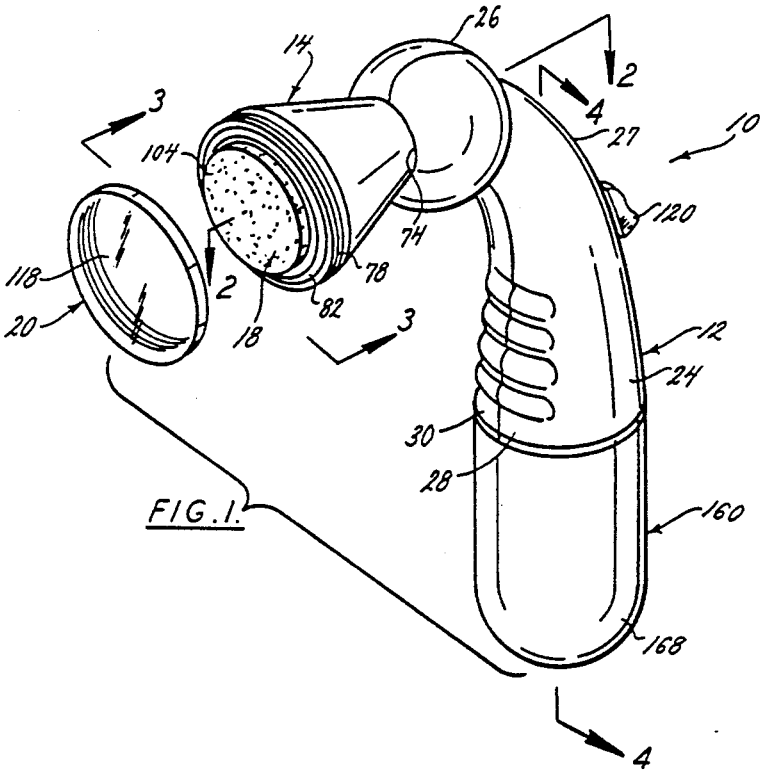
FIG. 1 is a perspective view of an applicator of the present invention.

With reference to the drawing there is shown a liquid dispensing applicator 10 of the present invention for applying multiple liquids to the human body particularly for the purpose of preventing sunburn. The applicator 10 generally comprises a handle 12, a head 14 located at the top of the handle, a distributor disk 16 recessed at the outer end of the head 14, an applicator pad 18 adjacent the disk and outwardly therefrom for receiving the liquids from the disk, a protective cap 20 removably secured to the head to overly the pad 18 and protect it when the applicator is not in use, and pumps 22 for pumping the liquids to the distributor disk and the pad for application to the body.

The handle 12 has a handle grip portion 24 and an upper spherical portion 26. The handle is smoothly curved at 27 from the grip portion 24 to the spherical portion 26 to provide approximately a 90° bend or curve in the handle. The portions of the handle comprising the grip portion 24, the curve portion 27, and the spherical end portion 26 are formed of two generally half sections 28 and 30 with a dividing wall 32 extending up the center of the portions 24 and 27 to divide them into two liquid chambers 34 and 36. At the bottom of the grip section 24 is a wall 40 having threaded openings 42 and 44 that received threaded fill caps 46 and 48. The chambers 34 and 36 are filled with liquid through the openings 42 and 44, the fill caps 46 and 48 retaining the liquids in the chamber.

The tops of the chambers are defined by a wall 50 at the base of the spherical portion 26, the wall 32 intersecting the wall 50. The wall 50 has openings 52 and 54 with nipples 56 at each side of each of the openings for connecting tubes thereto as will be further explained.

The spherical end 26 has a wall 60 with a central opening 62 for receiving a portion of the head 14 as will be described, and openings 64 and 66 through which tubes extend as will be described. The spherical section 26 has an opening 68 at its front end to receive the head 14.

The head 14 is generally conical and terminates at its back end in a spherical knob 70. It has an annular groove 72 generally at the junction between the conical portion and spherical knob that fits within the opening 62 in the wall 60. The conical portion also has an annular groove 74 that fits within the opening 68 at the end of the spherical section 26 so that the head 14 is secured within the spherical section 26 of the handle.

The front end of the head 14 has external threads 78 and an annular groove 80 to receive an 0-ring 82. The front end of the head 14 also has an annular recess 84 that receives the distributor disk 16 and a portion of the pad 18. The head also has fluid passages 86 and 88 that lead from locations within the spherical section 26 of the handle to locations within the recess 84. The head has nipples 90 and 91 within the spherical section 26 for connecting tubes as will be explained.

Figure 2:
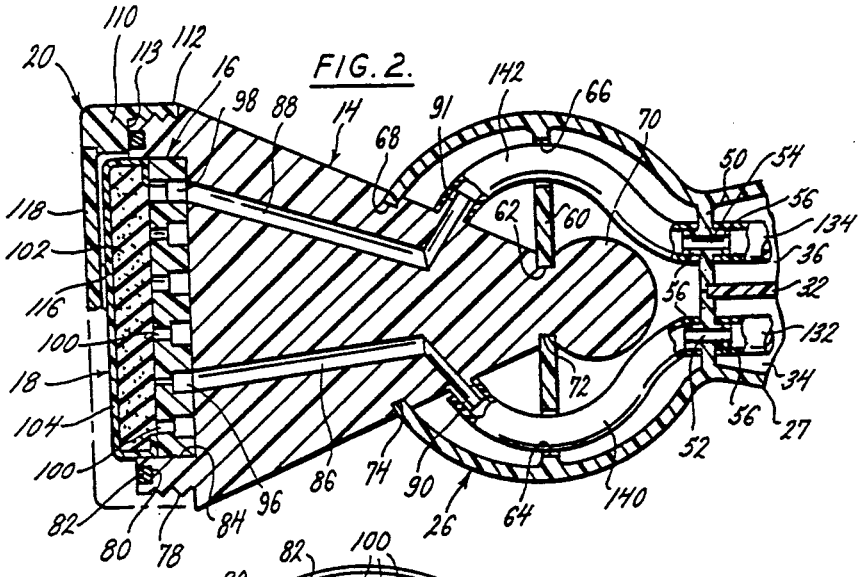
FIG. 2 is a view in section taken generally along the line 2—2 of FIG. 1.
Figure 3:
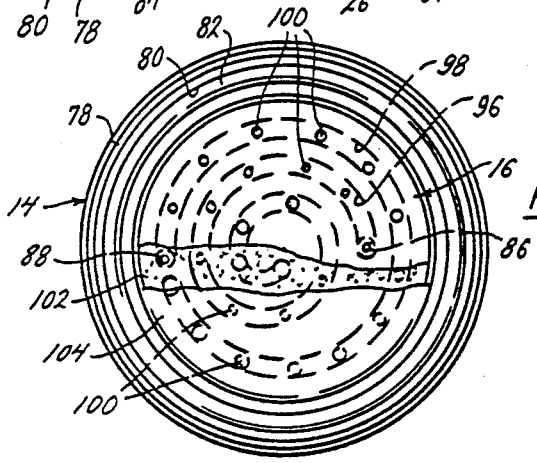
FIG. 3 is a view in section taken generally along the line 3—3 of FIG. 1.

As shown in FIGS. 2 and 3, the distributor disk 16 has an inner spiral groove 96, and an outer generally circular groove 98 formed in the back surface. Each groove has spaced holes 100 along the groove that extend through the disk from the base of the groove to the front face of the disk. The sizes of the holes become progressively larger around each groove, the smallest hole being at the end of each groove where the passages 86 and 88 intersect the grooves 96 and 98 respectively. As shown in FIG. 2, when the disk 16 is seated within the recess 84 of the head, the groove 96 aligns with the passage 86 in the head, and the groove 98 aligns with the passage 88 in the head, so that liquid fed through the passage 86 enters the groove 96 and is fed through the holes in the groove 96, and liquid fed through the passage 88 is fed to the groove 98 and is fed through the holes in the groove 98.

The pad 18 overlies the front surface of the distributor disk 16 and comprises a sponge-like material 102 with a relatively slick or smooth permeable front surface 104. Liquids from the disk enter the sponge pad 18 and pass through the surface material 104 when the pad is pressed against the skin for applying the liquids.

The protective cap 20 has an annular rim 110 with a threaded flange 112 for engaging the threads 78 of the head to removably secure the cap to the head. The rim also has a flat annular bearing surface 113 that bears against the 0-ring 82 when the cap is secured to the head to prevent the liquids from leaking when the applicator is not in use applying the liquids to the body. The cap also has a recess 116 to accommodate the front portion of the pad 18, and a protective lens 118 secured within the rim to overly the front of the pad.

The pumps 22 are mounted at the back of the handle and have actuating members 120 that extend through openings 122 in the back of the handle. Each pump has an inlet fitting 124 and an outlet fitting 126 to which tubes are connected. Tubes 128 and 130 are connected to the inlets 124 of the pump and extend downwardly into the chambers to receive the liquids in the chambers and feed them to the pumps. Tubes 132 and 134 are connected between the outlets 126 of the pumps and the nipples 56 at the upper wall 50 of the chambers. Tubes 140 and 142 are connected between the nipples 56 at the wall 50 and the nipples 90 and 91 at the head 14.

Each actuator 120 extends through a small compartment 150 formed by a plastic encasement 152, there being a suitable opening in the encasement generally at the location 154 where the rod of the actuator extends into the compartment. Suitable bushings are used to prevent the liquids in the chambers from leaking into the compartments 150.

The handle 12 further comprises a telescoping handle portion 160 (FIGS. 1, 4 and 5) which includes four telescoping sections 162, 164, 166 and 168. The inner most section 162 has an annular flange 170 at its upper end with internal threads 172 that engage mating external threads 174 at the bottom of the grip portion 24. The flange also has external threads 176. The lower end of the section 162 has external threads 178 that mate with internal threads 180 at the upper end of the section 164. Likewise, the section 164 has external threads 182 at its lower end that mate with internal threads 184 at the upper end of the section 166. The section 166 has external threads 186 that mate with internal threads 188 at the upper end of the outermost section 168 with the handle in the extended position. In the collapsed position, the threads 188 mate with the threads 176. The outer section 168 is rounded at the bottom.

All of threads are "right hand" threads except the mating threads 172 and 174 that connect the inner telescoping section 162 to the lower end of the grip portion 24, which are "left hand" threads. In other words, the telescoping section 162 is attached to the grip portion by turning the section 162 clockwise relative to the grip portion.

To fully extend the handle, the outermost telescoping section 168 is unscrewed from the upper threads 176 of the innermost section 162, whereupon the telescoping section may be extended. Upon further counterclockwise turning of the outermost section, while applying tension by holding the grip portion in one hand and the outermost section 168 in the other, the section 168 will threadedly engage the section 166, the section 166 will threadedly engage the section 164, and the secure the telescoping sections in the extend position shown in FIG. 5.

To gain access to the fill caps 46 and 48, with the telescoping sections in the extended position, the inner section 162 is turned clockwise to remove it from the grip portion, thereby exposing the caps 146 and 148 for removal of the caps and filling the chambers. After filling, the telescoping portion is again attached to the grip portion by turning the inner section 162 counterclockwise to engage the section 162 with the grip portion.

To collapse the telescoping portion, each of the sections 164, 166, and 168 are turned clockwise until their mating threads disengage so that the sections can be collapsed. To secure the telescoping portion in the collapsed position, the outer section 168 is turned clockwise to tighten it onto the threads 176 at the top of the section 162 as shown in FIG. 4. To gain access to the fill caps with the handle in the collapsed position, the outer section 168 is turned clockwise to unscrew the entire telescoping portion 160.

The operation of the applicator is evident from the foregoing description. To apply the liquid to the body, the protective cap is removed. The applicator is held by the hand at any desired location along the handle to apply the liquids that have been fed to the applicator pad to the skin. The telescoping portion of the handle may be extended as desired to more easily reach various areas of the body. When it is necessary to feed more liquid to the applicator pad, the user of the device operates the actuators 120 with his or her thumb to pump additional liquids to the pad by way of the various tubes, the passages 86 and 88 in the head 14, and further by way of the distributor disk 16 to provide a generally uniform distribution of the fluids over the applicator pad for application to the body. For example, one of the chamber may contain either suntan lotion or oil, and the other chamber may contain water. The two liquids are not mixed until they reach the pad, whereupon the two liquids are absorbed into the sponge-like material of the pad.

Most of the applicator may be of plastic. As previously mentioned, the handle portions 24, 27 and 26 may be of two generally identical half-sections joined together and sealed to each other at their mating surfaces. The dividing wall 32 may be a separate piece that is placed in position and sealed in place during assembly before the half sections are joined.

There are various changes and modifications which may be made to the invention as would be apparent to those skilled in the art. However, these changes or modifications are included in the teaching of the disclosure, and it is intended that the invention be limited only by the scope of the claims appended hereto.

We claim:

1. An applicator for applying a plurality of liquids, such as for tanning, at the same time to the human body comprising:

a handle;

an applicator head at the top of the handle, said head receiving a pad for contact with the body where the liquids are to be applied;

at least two chambers within said handle for separately containing said liquids; and means for feeding each liquid separately from a chamber to the applicator pad for application to the body upon contact with the pad; and a distributor at the outer end of the head, said pad overlying said distributor, said distributor having a first distribution means for distributing one of the liquids at multiple locations substantially throughout the pad, and a second distribution means for distributing the other of the liquids at multiple locations substantially throughout the pad, said first and second distribution means distributing each liquid separately to said pad, whereby mixture of said liquids first occurs in said pad at multiple locations substantially throughout the pad.

2. The applicator of claim 1 wherein said feeding means includes pumps for pumping the liquids from the chambers to the applicator pad.

3. The applicator of claim 1 wherein said handle further comprises telescoping sections operable between collapsed and extended positions for extending the length of the handle for easier access to portions of the body.

4. The applicator of claim 1 further comprising a distributor disk at the outer end of the head between the head and pad, said disk having first and second sets of openings; and means for delivering one of the liquids to one set of openings, and means for delivering another liquid to the other set of openings, said openings communicating with said pad, whereby said pad receives said liquids from the first and second sets of openings for application to the body.

5. The applicator of claim 1 further comprising a protective cap removably secured to the outer end of the head over the pad to protect the pad and prevent leakage of the liquids therefrom when not in use.

6. The applicator of claim 2 wherein said pumps are mounted to the handle and have actuators accessible to the thumb of the user for operating the pumps while holding the applicator by the handle.

7. The applicator of claim 3 wherein the telescoping handle sections have threaded engagement means for securing the sections in the collapsed and extended positions.

8. The applicator of claim 3 wherein the telescoping sections are removably attached to the remaining handle portions containing said chambers, a fill inlet to each chamber for filling the chamber with a selected liquid, access to said fill inlets being gained upon removal of said telescoping sections.

9. The applicator of claim 4 wherein the openings in each set define a curved pattern in the disk.

10. The applicator of claim 4 wherein said distributor disk has first and second annular grooves in a face surface thereof, and a series of openings extending through the disk in communication with the grooves, said liquid feeding means further comprising means for feeding each of the liquids from a chamber to a groove, thence through the openings, and thence to the applicator pad.

11. The applicator of claim 1 wherein the handle has a grip portion for gripping by the hand when using the applicator, and wherein said pad has a front surface for contact with the skin when applying the liquids to the body, the axis of said front pad surface being generally normal to the axis of said grip portion for easy access to portions of the body.

12. The applicator of claim 11 wherein said handle has a curved portion between the grip portion and the applicator head.

13. An applicator for applying a plurality of liquids, such as for tanning, at the same time to the human body comprising:

a handle having a grip portion for gripping by the hand when using the applicator, and a curved portion;

an applicator head at the top of the handle, said curved portion being located between the grip portion and the head, said head having a pad for contact with the body where the liquids are to be applied;

at least two chambers within said handle for separately containing said liquids; and means for feeding the liquids from the chambers to the applicator pad for application to the human body upon contact with the pad;

said handle further comprising telescoping sections operable between collapsed and extended positions for extending the length of the handle for easy access to portions of the body, the telescoping sections being removably attached to the remaining handle portions containing said chambers.

14. The applicator of claim 13 further comprising a distributor disk at the outer end of the head between the head and pad, said disk having first and second sets of openings; and means for delivering one of the liquids to one set of openings, and means for delivering another liquid to the other set of openings, said openings communicating with said pad, whereby said pad receives said liquids from the first and second sets of openings for application to the body.

15. The applicator of claim 14 wherein the openings in each set define a curved pattern in the disk.

16. The applicator of claim 13 wherein the telescoping handle sections have threaded engagement means for securing the sections in the collapsed and extended positions.

17. The applicator of claim 13 further comprising a fill inlet to each chamber for filling the chamber with a selected liquid, access to said fill inlets being gained upon removal of said telescoping sections.

* * * * *